United States Patent [19]

Kohl

[11] 4,255,947

[45] Mar. 17, 1981

[54] WARP KNITTING MACHINE WITH WEFT INSERTION APPARATUS

[75] Inventor: Karl Kohl, Obertshausen, Fed. Rep. of Germany

[73] Assignee: Karl Mayer Textil-Maschinenfabrik GmbH, Obertshausen, Fed. Rep. of Germany

[21] Appl. No.: 958,439

[22] Filed: Nov. 7, 1978

[30] Foreign Application Priority Data

Nov. 9, 1977 [DE] Fed. Rep. of Germany ..... 2736977

[51] Int. Cl.[3] ..... D04B 23/06; D04B 23/10; D04B 23/08; D04B 23/12

[52] U.S. Cl. ..... 66/84 A

[58] Field of Search ..... 66/125 R, 84 A

[56] References Cited

U.S. PATENT DOCUMENTS

| | | | |
|---|---|---|---|
| 1,680,614 | 8/1928 | Hill et al. | 66/84 A |
| 1,924,649 | 8/1937 | Morton | 66/84 A |
| 3,099,921 | 8/1963 | Liebrandt | 66/214 |
| 3,648,459 | 3/1972 | Fürst et al. | 66/84 A |
| 3,774,414 | 11/1973 | Vogel | 66/84 A |
| 3,797,278 | 3/1974 | Kohl | 66/84 A |
| 3,832,868 | 9/1974 | Derich et al. | 66/84 A |
| 3,834,189 | 9/1974 | Kamp et al. | 66/84 A |
| 3,857,260 | 12/1974 | Zwingenberger | 66/84 |
| 3,916,649 | 11/1975 | Kohl | 66/84 A |

FOREIGN PATENT DOCUMENTS

| | | | |
|---|---|---|---|
| 63603 | 9/1968 | German Democratic Rep. | 66/214 |
| 1864 | of 1890 | United Kingdom | 66/214 |

*Primary Examiner*—Ronald Feldbaum
*Attorney, Agent, or Firm*—Omri M. Behr

[57] ABSTRACT

Stationary spools located at one end of a warp knitting machine are coupled to thread providing means which in turn is coupled to a thread transfer means for carrying the weft threads across the full bed of the warp knitting machine. The weft thread providing means and the transfer means in addition to means for removing the weft threads from the transfer means are disposed within the volume delineated by the needle bed, push rod and guide bar drive levers of the knitting machine and are disposed a position between the forwardly and rearwardly disposed guide bars thereof.

4 Claims, 4 Drawing Figures

WARP KNITTING MACHINE WITH WEFT INSERTION APPARATUS

BACKGROUND OF THE INVENTION

1. Field of the Invention

This invention relates generally to warp knitting machines, and more particularly, to a weft inserting apparatus for use on warp knitting machines.

2. Description of the Prior Art

The prior art abounds with many different types of weft inserting devices that are known to those of ordinary skill in the knitting machine art. Several of these are discussed in U.S. Pat. No. 3,916,649 to Karl Kohl. However, these include the following disadvantages: If the spools are required to be in motion, and there is weft breakage or the like, the complete weft inserting mechanism must be stopped; the threads must pass through long lever guides which cause undesirable friction forces and may tend to tear the threads; a "FIG. 8" feed mechanism causes undesirable thread abrasion if the path of the thread from the spool to the thread guide is not straight and direct; or a magazine type of arrangement which changes the warp threads from a tensioning chain to a magazine, and in turn, transfers the warp threads to the needle bed to be entrapped by the ground threads of the warp knitting machine includes additional driving mechanisms and chains increasing the chances of breakdown.

Thus, the prior art includes the embodiment wherein the weft thread is extended the entire length of the machine by an angle thread transmission means which obtains the successive threads from a weft thread provider disposed on one side of the warp knitting machine. Prior art machines of this type also utilize weft thread magazines, which are adapted to receive the weft threads from the angle thread provider that provides the weft threads one after another, parallel to the needle bed of the machine, and then in turn, presents the weft threads to the needle bed at each predetermined stitch as desired.

In most cases, the prior art magazines include an arrangement having transport chains provided perpendicular to the needle bed disposed on both sides of the machine. The magazine was generally on the rearward side of the needle bar. Since the guide bars had to be driven from both sides of the machine and the magazine driving mechanism which was required to have a transport driving means located on both sides of the machine also, had to be contained within the available space. With limited space it was impossible to build magazines of very great width, or if relatively large widths were utilized, it was necessary to reduce the number of weft threads that were available for insertion. Also, since the weft threads must pass through an additional mechanism such as a magazine requires, additional means to maintain thread cleanliness and means must be provided to prevent the loss of tension as the threads travel in a thread-tensioning device.

SUMMARY OF THE INVENTION

The present invention overcomes the shortcomings found in the prior art by positioning the thread provider and the thread transfer means between the needle bed and the push rods which are used to activate the guide bar drive levers, and are positioned between forwardly and rearwardly disposed guide bars, thereby, permitting an increase in the density of weft threads. The traditional magazine arrangement, which requires the use of thread clips or retainers and other associated driving means, can now be eliminated.

Heretofore, prior art warp knitting machines having full length weft insertion apparatuses were unable to provide ware having an appearance on the viewing side of the material which is substantially the same in appearance to woven goods, since on the left side of the ware, the inserted weft threads are strongly pushed back in relationship to the stitch forming warp threads.

The present invention overcomes the shortcomings found in the prior art by providing a thread provider means and thread transfer means located in front of at least one guide bar which is suspended from a special support beam. The laying of the weft inserted thread occurs over the entire width of the machine between the guide bars, whereby it is now possible to provide for the appearance of the weft thread on the left side of the ware to substantially the same extent as stitch forming warp threads, thus, providing an appearance substantially equivalent to that of woven goods.

In the preferred configuration the movement of the guide bar behind the weft insertion apparatus provides an open space between the guide bars when the needles move in a downwardly direction to the bottom of the cycle. During this time, the fully stretched out weft threads can be pulled between the guide bars to a position in front of the needles by means of grabbers. It is only after the weft thread lies in front of the needle that the rearward guide bar swings forward.

The weft insertion apparatus of the present invention is positioned so that the forward guide bars during the overlap and the rearward guide bars during the underlap do not physically contact the weft insertion apparatus. The weft insertion apparatus does not move and performs no lapping movements.

Prior art machines place weft threads between the guide bars but only on short, partial weft thread insertions in so-called reverse laps, but this does not accomplish the desired purpose.

A weft thread inserting apparatus for use with a warp knitting machine having a needle bed, a plurality of guide drive levers with guide bars affixed thereon, and push rods operatively connected thereto, comprises in combination; thread provider means for supplying a plurality of weft threads, thread transfer means for carrying each of the weft threads across the width of the knitting machine proximate the needle bed and disposed substantially within the space bounded by by the needle bed, the push rods, the guide bar drive levers, and between forwardly and rearwardly disposed guide bars, and means for removing the weft threads from the transfer means and positioning them proximate at the needle bar at the proper time of the knitting cycle, at least one of the removing means being disposed proximate each end of the needle bed.

Another feature of the present invention will be more fully understood with reference to the following drawings.

DESCRIPTION OF THE PREFERRED EMBODIMENT

Figure 1:
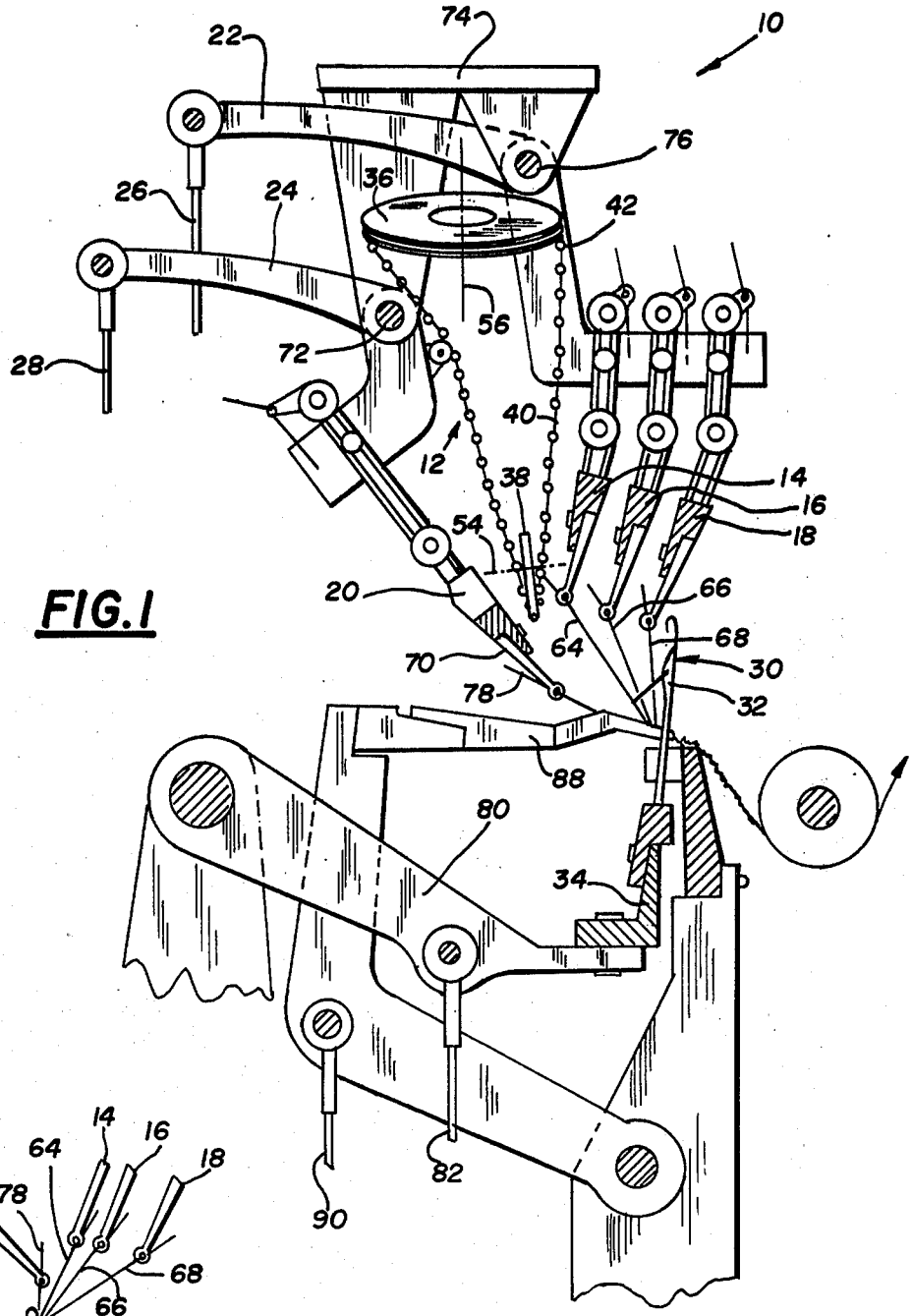
FIG. 1 is a partial side elevation view of a warp knitting machine with the weft inserting apparatus disposed therein, according to the principals of the present invention.
Figure 3:
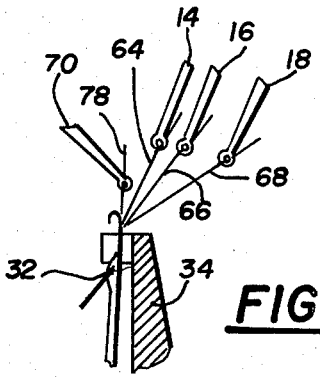
FIGS. 2 and 3 are a pictorial representations of the thread forming mechanisms in two different positions of the knitting cycle.

Referring now to the figures, and in particular to FIG. 1, which shows a partial side view in elevation of a warp knitting machine 10 with a weft inserting apparatus 12 disposed within the volume defined by forwardly mounted guide bars 14, 16, and 18 are rearwardly mounted guide bar 20; guide bar drive levers 22 and 24; push rods 26 and 28 operatively connected to guide bar drive levers 22 and 24, respectively; and needle bed 30 which includes a plurality of needles 32 affixed in a needle bar 34, in a conventional manner. The driving mechanisms for the push rods 26 and 28; needle bar 34; etc. have not been shown because they are conventional and well-known by those knowledgeable in the art. However, if such information is necessary reference may be had to a textbook entitled Warp Knitting Technology by D. F. Paling, published by the Columbine Press (publishers) Ltd. in 1952 and reprinted in 1970.

The weft inserting apparatus 12 of the present invention includes two wheels 36 and 38 and a chain-drive 40 operatively coupled between the two wheels 36 and 38. Chain 40 is provided with a plurality of thread clamping devices 42 equally spaced thereon. Preferably, wheel 38 is smaller than wheel 36 and wheel 38 is driven by a bevel gear 44 operatively coupled thereto and coupled to the main drive mechanism of the warp knitting machine, not shown (see FIG. 4). The wheels 36 and 38 and associated chain-drive 40 are more commonly referred to as a thread transfer device 46 which cooperates with the thread providing device, 48 shown in FIG. 4. The thread providing device 48 obtains the weft threads 50 obtained from a plurality of spools 52 disposed along one side of the warp knitting machine 10. The weft threads 50 come into contact with the thread clamping devices 42 affixed to the chain 40 and are carried across the complete width of the machine by the chain 40 until they are disposed proximate the needle bed 30. In order to properly position the weft threads 50 with respect to the needle bed 30, the axis 54 of wheel 38 (FIG. 1) is preferably positioned substantially perpendicular to the plane formed by the needles 32. The axis 56 of wheel 36 is preferably positioned parallel or somewhat biased towards the needles 32.

In order to insure that the weft thread segment 50 is properly positioned behind the rearmost positioned guide bar 14 of the forward group of guide bars 14, 16 and 18 without becoming entangled on the rear guide bar 20 a fender 58 (see FIG. 2) is affixed to guide bar 20 in a conventional manner. This insures that the thread 50 will move in the direction of arrow 60 when urged in a downwardly direction by the grabber mechanism 62 to a position in front of the needles 32 prior to engagement by the guide bar threads 64 66 and 68. It is not necessary that every guide 70 mounted on guide bar 20 be protected with a fender 58, it is only necessary that one or more guides are so protected to insure free movement of the weft thread segments 50.

Figure 2:
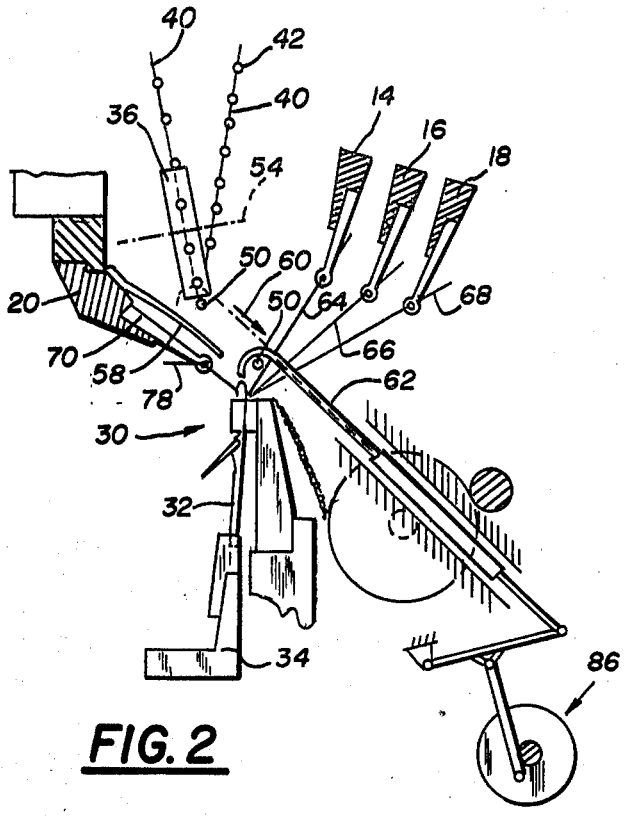
Figure 4:
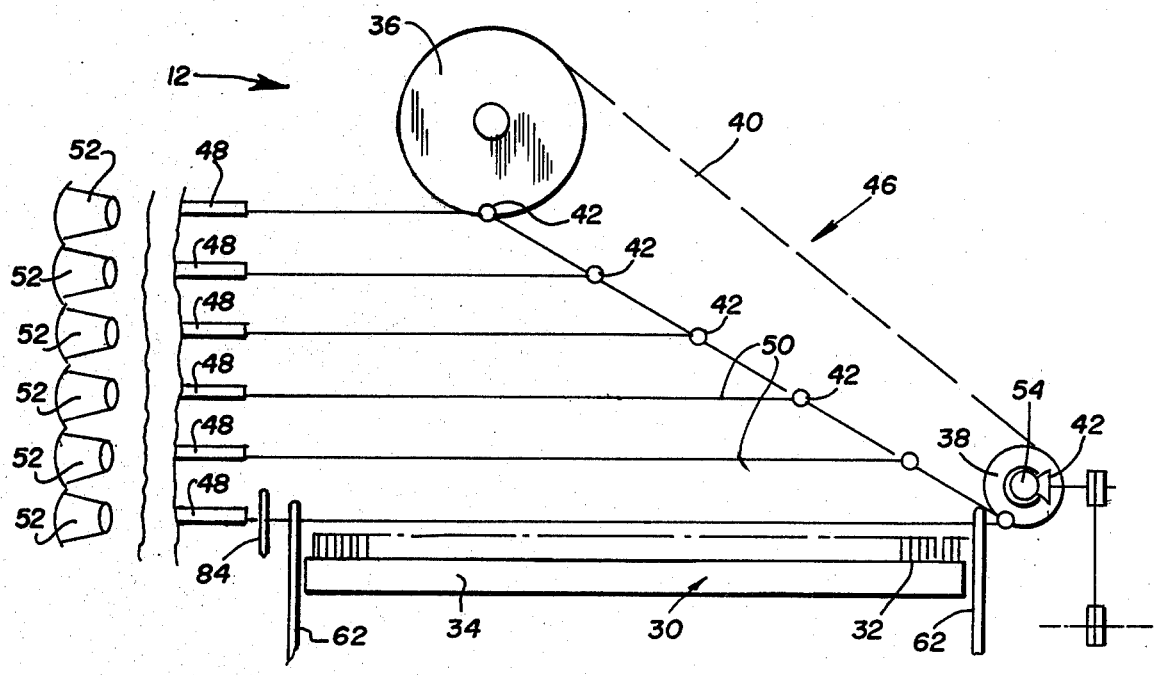
FIG. 4 is a partial plan view of the warp knitting machine and weft inserting apparatus as shown in FIG. 1.

With regard to the weft thread grabbers 62 shown in cross section in FIG. 2 and a front view thereof shown in FIG. 4, it is to be noted that they are positioned on both ends of the needle bar and operate between the front guide bars 14, 16 and 18 which are positioned in front of the weft insertion apparatus 12 in the underlap position and the rear guide bar 20 positioned behind the weft insertion apparatus 12, in the overlap position.

The rear guide bar 20 is supported by a special support beam 72 (FIG. 1) which is suspended from the warp knitting machine frame 74, in a conventional manner, in addition to the conventional beam 76 about which guide bars 14, 16 and 18 are rotated. As mentioned earlier the guide bar drive levers 22 and 24 are coupled to the warp knitting machine source of driving power not shown.

The position shown in FIG. 2 occurs when the forward guide bars 14, 16 and 18 have moved forwardly into the overlap position. The rearward guide bar 20 is shown prior to starting the underlap position. Thus, there is created a space between the forward and rearward guide bars in which a pair of grabbers 62 coupled, via a mechanism 86, to the warp knitting machine drum, not shown, can move in a leftwardly direction opposite to arrow 60 and thence to the right in the direction of arrow 60 and carry the weft thread segment 50 to the right of the needle bed 30 in front of the needles 32. After the thread is in position in front of needles 32 the rearward guide bar 20 swings in a forwardly direction carrying guide bar thread 78 to the underlap position. The weft thread segment 50 now finds itself between the thread 78 of the rearward guide bar and the threads 64, 66 and 68 of the forward guide bars 14, 16 and 18. Thereafter, the needles 32 are caused to rise by drive lever 80 which is activated by push rod 82 that is coupled to the warp knitting machine source of power, not shown, and commences the next stitch formation.

Additionally included is a conventional type of cutting mechanism 84 which is positioned proximate the needle bed 30 and on the side of the warp knitting machine proximate the spools of weft thread 52 and the thread providing device 48.

The warp knitting machine 12 also includes a conventional sinker bar 88 which is coupled to the push rod 90 and to the warp knitting machine drive mechanism in a conventional manner not shown.

Hereinbefore has been disclosed a weft insertion apparatus for use with warp knitting machines. It will be understood that various changes in the details, materials, arrangement of parts and operating conditions which have been herein described and illustrated in order to explain the nature of the invention may be made by those skilled in the art within the principals and scope of the present invention.

Having thus set forth the nature of the invention what is claimed is:

1. A weft inserting apparatus for use with a warp knitting machine having a needle bed, a plurality of guide bar drive levers with guide bars affixed thereon, and push rods operatively connected thereto, comprises in combination:

(a) thread provider means for supplying a plurality of weft threads;

(b) thread transfer means for carrying each of said weft threads across the width of said knitting machine proximate said needle bed, said thread transfer means being disposed substantially within the space bounded by said needle bed, said push rods, said guide bar drive levers, and between forwardly and rearwardly disposed guide bars; and (c) means for removing said weft threads from said transfer means and positioning them proximate said needle bar at the proper time of the knitting cycle, at least one said removing means being disposed proximate each end of said needle bed.

2. A weft inserting apparatus according to claim 1 wherein said thread transfer means includes:

(a) a first wheel disposed proximate said thread provider means, said first wheel axis being generally parallel to the plane formed by said needles;

(b) a second wheel disposed proximate said needle bed, said second wheel axis being generally perpendicular to the plane formed by said needles; and (c) continuous chain means circumscribing said first and second wheels, said chain means including a plurality of thread clamping means spaced therealong.

3. A weft inserting apparatus according to claim 1 wherein at least two of the most rearwardly disposed guide bars have affixed thereto fender means for avoiding said weft threads when they are removed from said thread transfer means said fender means being disposed on the surface of said guide bar facing the openings of the needles on said needle bed.

4. A weft inserting apparatus according to claim 1 further including a separate independent support beam for said rearward guidebar.

* * * * *